US007462078B2

(12) United States Patent
Mao

(10) Patent No.: US 7,462,078 B2
(45) Date of Patent: Dec. 9, 2008

(54) POWER CONNECTORS

(75) Inventor: Hu-Qing Mao, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/740,725

(22) Filed: Apr. 26, 2007

(65) Prior Publication Data

US 2008/0268717 A1 Oct. 30, 2008

(51) Int. Cl.
*H01R 13/187* (2006.01)

(52) U.S. Cl. ..... 439/843; 439/851

(58) Field of Classification Search ..... 439/843, 439/851, 852, 346

See application file for complete search history.

(56) References Cited

U.S. PATENT DOCUMENTS 5,921,822 A * 7/1999 Kennedy et al. ..... 439/851
6,042,432 A * 3/2000 Hashizawa et al. ..... 439/843
7,108,514 B2 9/2006 Chen et al.
2003/0207606 A1 * 11/2003 Ho ..... 439/346

* cited by examiner

*Primary Examiner*—Ross N Gushi
(74) *Attorney, Agent, or Firm*—WPAT, P.C.; Anthony King

(57) ABSTRACT

A power connector includes a main body and a conductive contact. The main body has a front surface and a sidewall. The front surface defines a receiving cavity. The front of the sidewall defines at least one positioning hole communicating with the receiving cavity, and then a blocking wall is formed at the front of the positioning hole. The conductive contact is received in the receiving cavity of the main body and has a fixing portion, a base portion and connecting portions connecting the fixing and base portions. The fixing portion is formed by a rectangular board bending to form an arch structure. The front of the fixed portion is cut to form at least one cut portion with a free end at front and a connecting end connecting to the fixing portion at back. The cut portion bends outwards to form a blocking lump, the blocking lump engages with the positioning hole and is blocked by the blocking wall. Therefore, the conductive contact can be fastened firmly and securely.

6 Claims, 5 Drawing Sheets

POWER CONNECTORS

BACKGROUND OF THE INVENTION

1. Field of the Invention

The present invention relates to a power connector, and more particularly to a power connector with a conductive contact fastened firmly and securely.

2. The Related Art

Power connectors are widely used in the field of electronics. A conventional power connector comprises a main body and a conductive contact received in the main body. In order to transmit an electrical signal steadily, it is necessary to ensure a certain pressing force between the conductive contact and a terminal of a mating connector while the mating connector is engaging with the conductive contact. Because of the pressing force, a pushing/pulling force between the conductive contact and the terminal of the mating connector arises when the terminal is inserted into or drawn out of the power connector, and the pushing/pulling force will make the conductive contact move forwards or backwards and affect the secure retention of the conductive contact in the main body of the power connector, and then affect the transmission of the electrical signal.

U.S. Pat. No. 7,108,514 discloses a conductive contact with a housing fixed at the front of a main body, to prevent the conductive contact from moving forwards or backwards. However, by this way, it must add another components. With the increase of the number of the components, the problems will increase too, for example, the housing looses from the main body, and then causes the unreliable engagement between the conductive contact and the main body. Therefore, the electrical signal is unsteadily transmitted.

SUMMARY OF THE INVENTION

An object of the present invention is to provide a power connector with a conductive contact fastened firmly and securely. The power connector comprises a main body and the conductive contact received in the main body. The main body has a front surface, a back surface and a sidewall. The front surface defines a receiving cavity. The front of the sidewall defines at least one positioning hole communicating with the receiving cavity and then a blocking wall is formed at the front of the positioning hole. The conductive contact is received in the receiving cavity of the main body and has a fixing portion, a base portion and connecting portions connecting the fixing and base portions. The fixing portion is formed by a rectangular board bending to form an arch structure, then an opening end is formed. The front of the fixed portion is cut to form at least one cut portion with a free end at front and a connecting end connecting to the fixing portion at back. The cut portion bends outwards to form a blocking lump. The blocking lump engages with the positioning hole and is blocked by the blocking wall.

As described above, the blocking lump of the conductive contact engages with the positioning hole of the main body, which prevents the conductive contact from rotating and moving in the main body and ensures the conductive contact being fastened firmly and securely. Therefore, the affection of the pushing/pulling force between the conductive contact and a terminal of a mating connector on the secure retention of the conductive contact in the main body is decreased or even eliminated. Thereby, a steady transmission of the electrical signal is achieved.

BRIEF DESCRIPTION OF THE DRAWINGS

The present invention will be apparent to those skilled in the art by reading the following description of two preferred embodiments thereof, with reference to the attached drawings, in which.

DETAILED DESCRIPTION OF THE PREFERRED EMBODIMENTS

Figure 1:
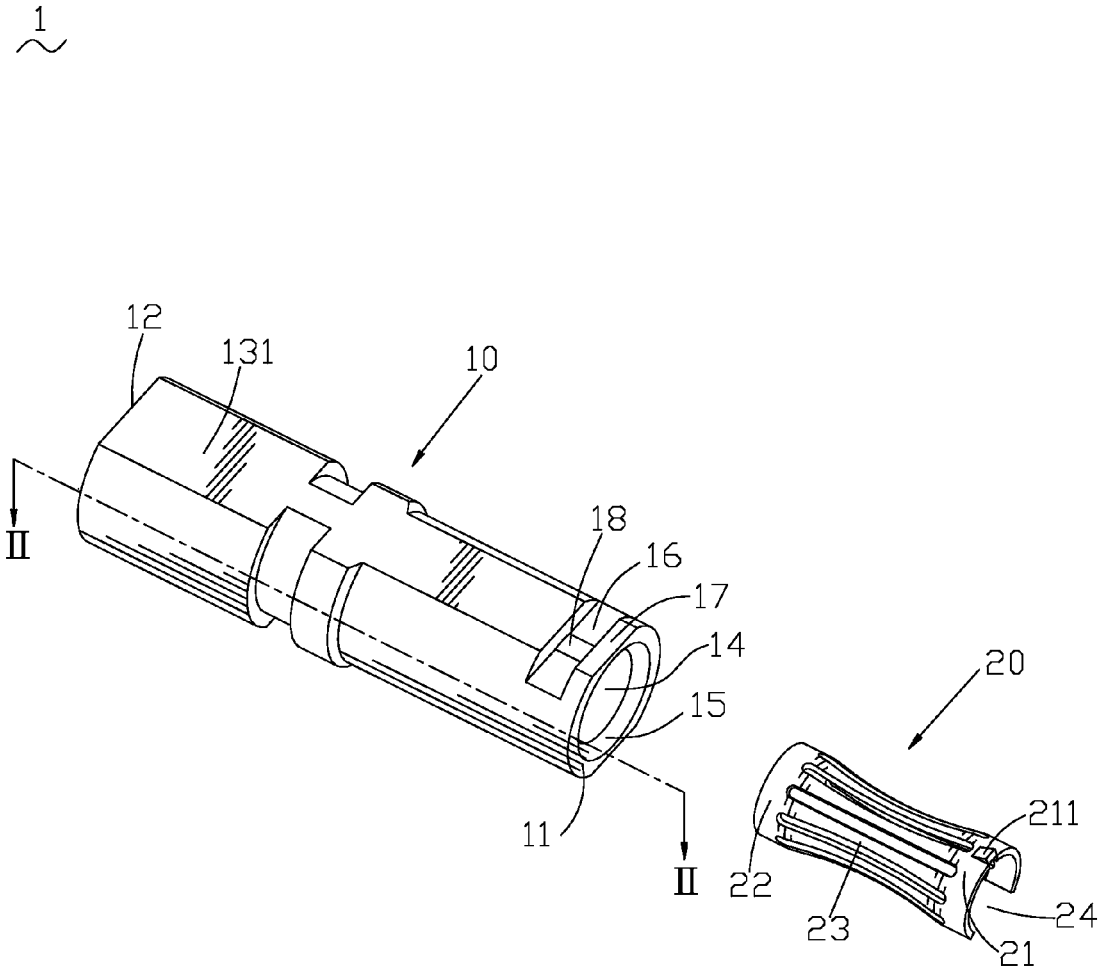
FIG. 1 is an exploded view of a power connector according to a first embodiment of the present invention.
Figure 2:
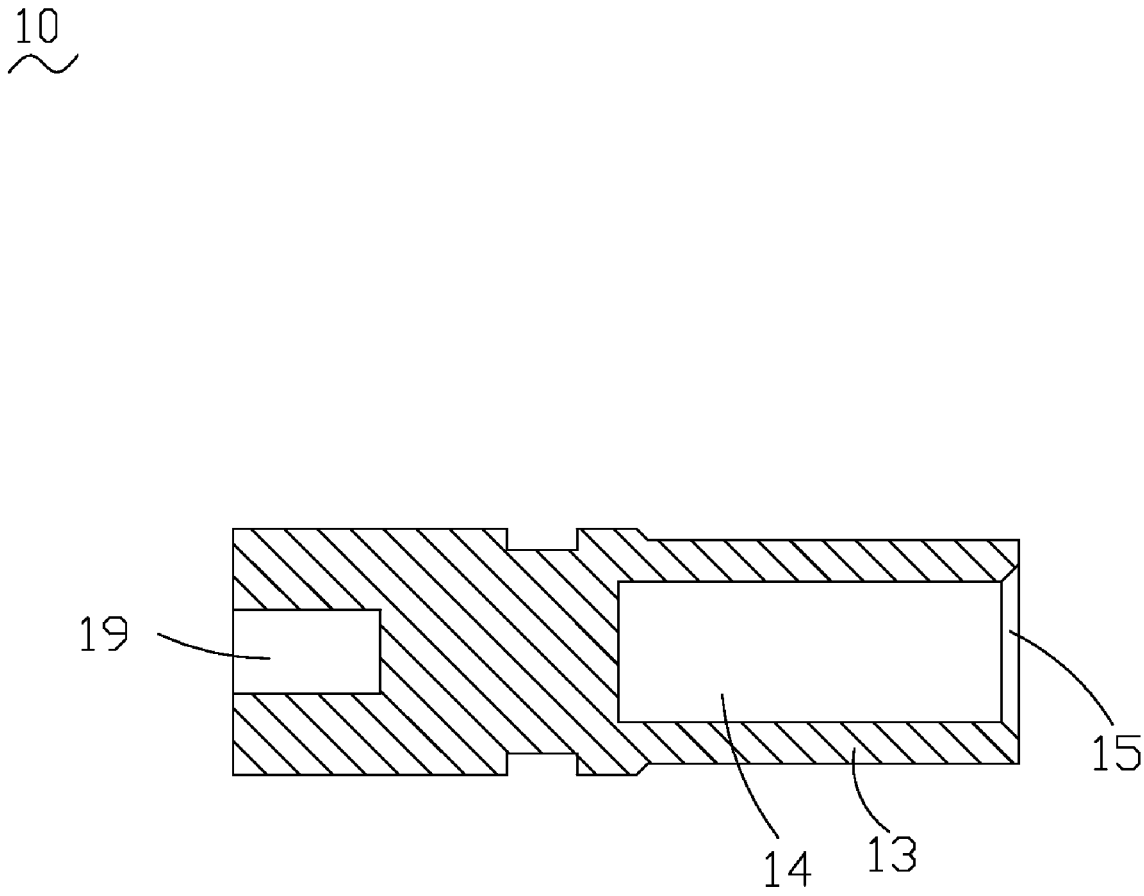
FIG. 2 is a cross-sectional view of the main body in FIG. 1 taken along II-II.

With reference to FIG. 1 and FIG. 2, a power connector 1 according to a first embodiment of the present invention is shown. The power connector 1 comprises a main body 10 and a conductive contact 20 received in the main body 10. The main body 10 is about a cylinder shape, having a front surface 11, a back surface 12 and a sidewall 13. A receiving cavity 14 is opened in the main body 10 from the front surface 11 to the middle part of the main body 10. There is a guiding portion 15 defined at the front of the receiving cavity 14. The guiding portion 15 is a trumpet shape, and connects with the front surface 11. The sidewall 13 comprises two parallel positioning surfaces 131. A groove 16 is opened at the front side of the main body 10, in this case, the groove 16 is defined in one of the positioning surfaces 131. And then a blocking wall 17 is formed at the front of the groove 16. The middle part of the groove 16 communicates with the receiving cavity 14 and forms a positioning hole 18 at the back of the blocking wall 17. A connecting cavity 19 is defined in the back surface 12 of the main body 10, and the connecting cavity 19 doesn't communicate with the receiving cavity 14. A wire (not shown) is received in the connecting cavity 19.

Referring to FIG. 1 again, the conductive contact 20 is about a cage shape and has a fixing portion 21, a base portion 22 and connecting portions 23 arranged equidistantly connecting the fixing and base portions 21, 22. The fixing portion 21 is formed by a rectangular board bending to form a arch structure, then an opening end 24 is formed. The middle portion of the connecting portion 23 bends inwards and forms an arc shape. The fixing portion 21 has a symmetrical structure, the front of the middle of the fixing portion 21 is cut to form a cut portion with a free end at front and a connecting end connecting to the fixing portion 21 at back. The cut portion bends outwards to form a slope-like blocking lump 211 protruding from the external surface of the fixing portion 21.

Figure 3:
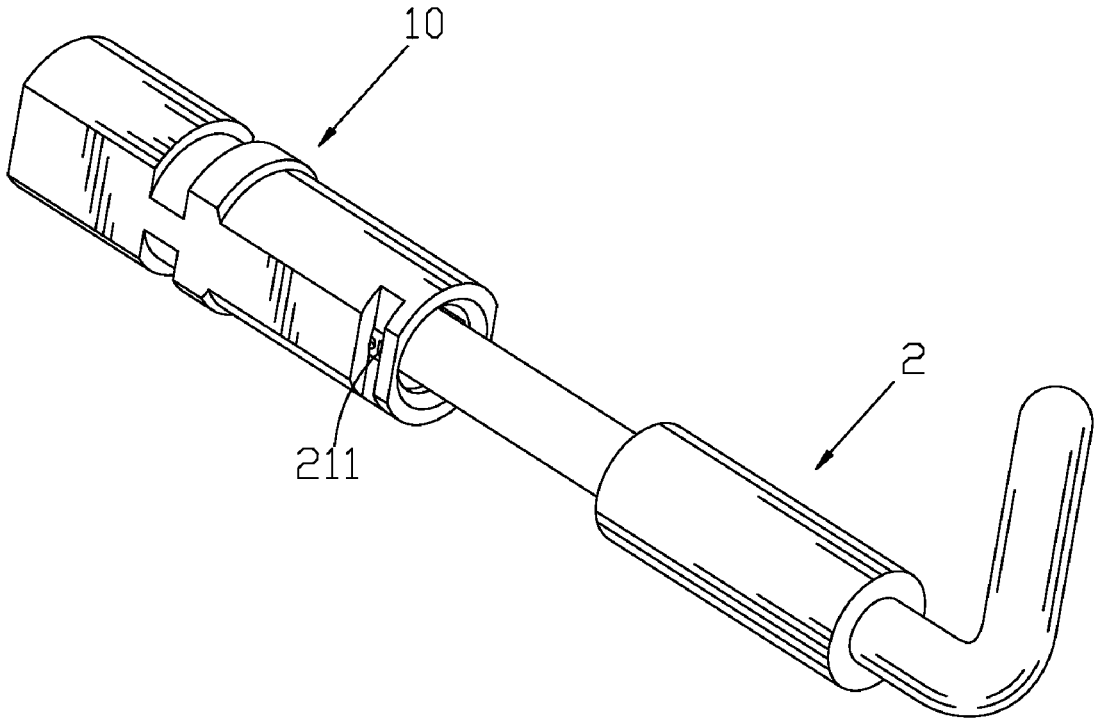
FIG. 3 is a perspective view of the power connector of the first embodiment engaging with a terminal of a mating power connector.

Referring to FIG. 3, the conductive contact 20 is inserted in the receiving cavity 14 along the guiding portion 15 from the front of the main body 10, the blocking lump 211 of the conductive contact 20 engages with the positioning hole 18 and is blocked by the blocking wall 17, so the conductive contact 20 cannot rotate or move in the main body 10. When a terminal 2 of a mating power connector is inserted in the conductive contact 20, a steady transmission of the electrical signal is achieved.

Figure 4:
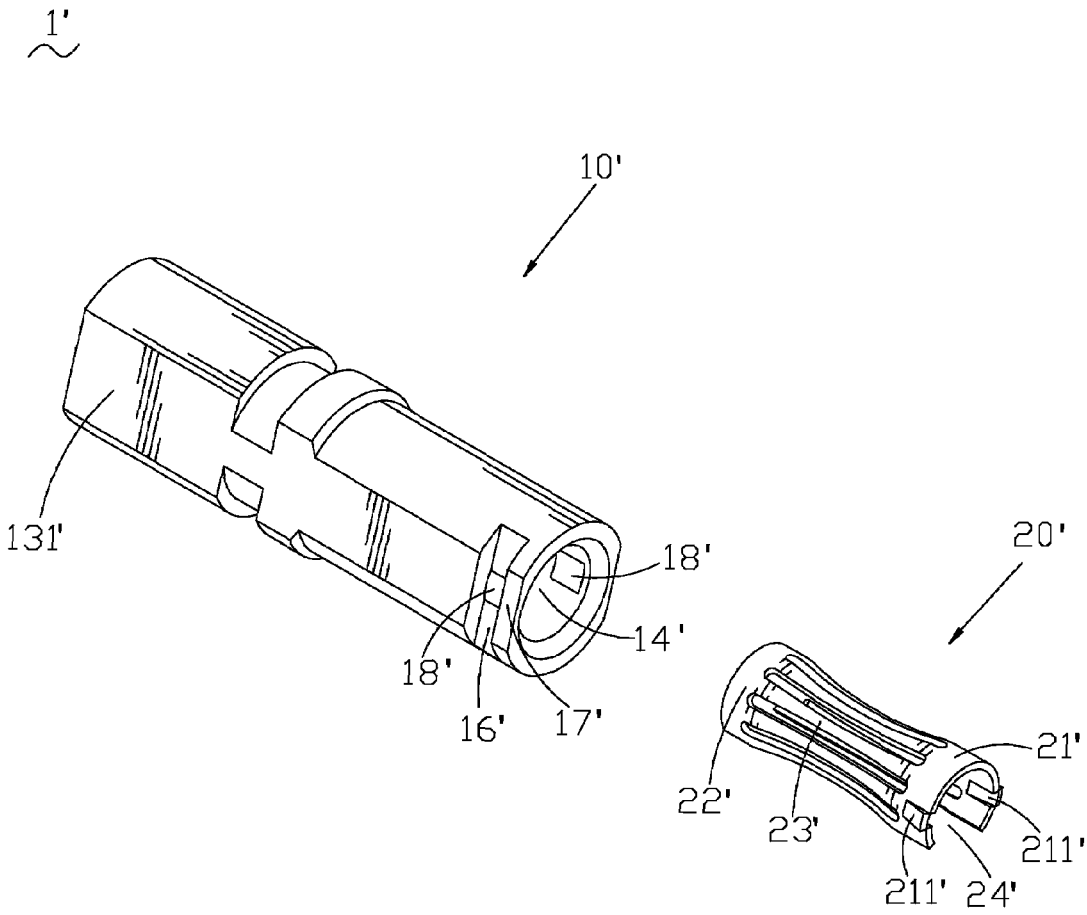
FIG. 4 is an exploded view of a power connector according to a second embodiment of the present invention.

Referring to FIG. 4, a power connector 1' according to a second embodiment of the present invention is shown. The differences between a main body 10' of the second embodiment and the main body 10 of the first embodiment are: two grooves 16' are opened in both positioning surfaces 131', and then two blocking walls 17' are formed at the front of the grooves 16'. The middle part of the groove 16' communicates with a receiving cavity 14' and forms a positioning hole 18' at the back of the blocking wall 17'.

Figure 5:
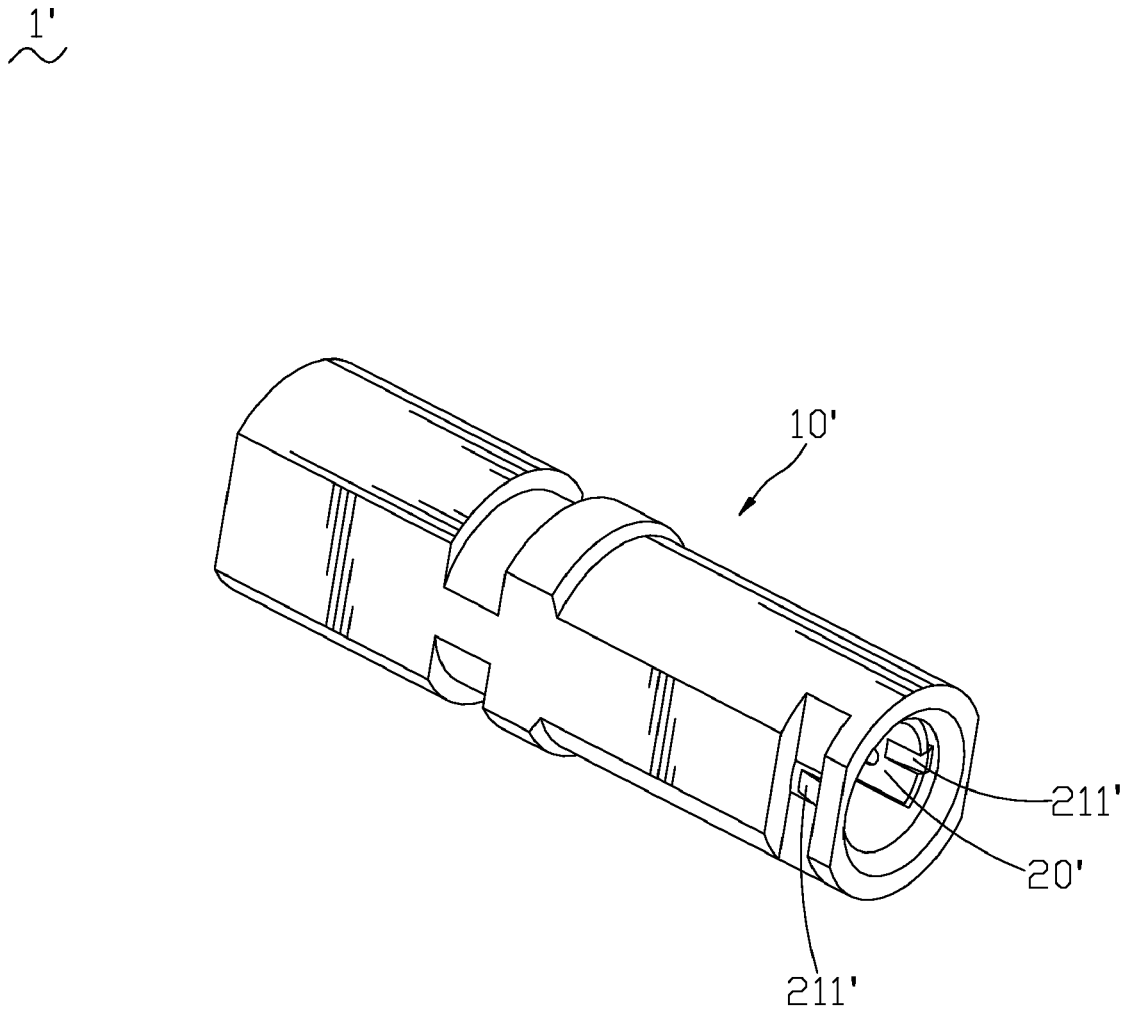
FIG. 5 is a perspective view of the power connector of the second embodiment.

The differences between a conductive contact 20' of the second embodiment and the conductive contact 20 of the first embodiment are: two symmetrical sides of a fixing portion 21' are cut to form two cut portions. Each cut portion has a free end at front and a connecting end connecting to the fixing portion 21' at back. The cut portion bends outwards to form two slope-like blocking lumps 211' protruding from the external surface of the fixing portion 21' for matching the positioning holes 18' of the main body 10'. Please refer to FIG. 5, the blocking lumps 211' engage with the positioning holes 18' and are blocked by the blocking walls 17', and then the conductive contact 20' is fastened in the main body 10'.

As described above, the blocking lump of the conductive contact engages with the positioning hole the main body. Therefore, the conductive contact is fastened firmly and securely in the main body, and the conductive contact cannot rotate or move in the main body. Thereby, a steady transmission of the electrical signal is achieved.

What is claimed is:

1. A power connector comprising:

a main body, having a front surface, a back surface and a sidewall, the front surface defining a receiving cavity, the front of the sidewall defining at least one positioning hole communicating with the receiving cavity and then a blocking wall being formed at the front of the positioning hole;

a conductive contact received in the receiving cavity of the main body, having a fixing portion, a base portion and connecting portions connecting the fixing and base portions, the fixing portion being formed by a rectangular board bending to form a arch structure, then an opening end being formed, the front of the fixed portion being cut to form at least one cut portion with a free end at front and a connecting end connecting to the fixing portion at back, the cut portion bending outwards to form a blocking lump, the blocking lump engaging with the positioning hole and being blocked by the blocking wall; and wherein the main body is about a cylinder shape, the sidewall of the main body comprises two parallel positioning surfaces.

2. The power connector as claimed in claim 1, wherein the back surface of the main body defines a connecting cavity for receiving a wire, the connecting cavity not communicating with the receiving cavity.

3. The power connector as claimed in claim 1, wherein one of the positioning surfaces defines a groove, the middle part of the groove communicating with the receiving cavity and forming the positioning hole.

4. The power connector as claimed in claim 3, wherein the fixing portion has a symmetrical structure, the blocking lump is formed at the middle of the fixing portion.

5. The power connector as claimed in claim 1, wherein the both positioning surfaces define two grooves, the middle part of the groove communicating with the receiving cavity and forming the positioning hole.

6. The power connector as claimed in claim 5, wherein the fixing portion has a symmetrical structure, the blocking lumps are formed at two symmetrical sides of the fixing portion for matching the positioning holes of the main body.

* * * * *